US009700477B1

(12) United States Patent
Franks et al.

(10) Patent No.: US 9,700,477 B1
(45) Date of Patent: Jul. 11, 2017

(54) WATER BASED PET CREMATION BASKET APPARATUS WITH ENHANCED STRENGTH

(71) Applicants: Alec John Franks, Monterey, CA (US); Jeffrey Alan Franks, Salinas, CA (US)

(72) Inventors: Alec John Franks, Monterey, CA (US); Jeffrey Alan Franks, Salinas, CA (US)

( * ) Notice: Subject to any disclaimer, the term of this patent is extended or adjusted under 35 U.S.C. 154(b) by 0 days.

(21) Appl. No.: 15/233,740

(22) Filed: Aug. 10, 2016

(51) Int. Cl.

| | |
|---|---|
| ***A61G 17/007*** | (2006.01) |
| ***A61G 99/00*** | (2006.01) |
| ***B65D 6/08*** | (2006.01) |
| ***B65D 25/04*** | (2006.01) |
| ***B65D 25/28*** | (2006.01) |
| ***B65D 43/02*** | (2006.01) |
| ***B65D 21/02*** | (2006.01) |

(52) U.S. Cl.
CPC ..... *A61G 17/0076* (2013.01); *A61G 99/00* (2013.01); *B65D 7/14* (2013.01); *B65D 21/0209* (2013.01); *B65D 25/04* (2013.01); *B65D 25/282* (2013.01); *B65D 43/02* (2013.01); *B65D 2525/283* (2013.01)

(58) Field of Classification Search
CPC .... A61G 17/08; A61G 17/0076; A61G 99/00; F23G 1/00; F23G 5/002; B65D 21/0211; B65D 7/20; B65D 7/14; B65D 25/282; B65D 43/02; B65D 21/0209; B65D 25/04; B65D 2525/283; B09B 3/00
USPC ..... 27/1, 21.1; 110/341, 194, 248; 220/486, 220/491, 23.28; 206/513, 503; 241/1, 241/301; 422/184.1; 588/317
See application file for complete search history.

(56) References Cited

U.S. PATENT DOCUMENTS

| | | | | | |
|---|---|---|---|---|---|
| 1,364,456 | A | * | 1/1921 | Scott | F23G 5/002 110/253 |
| 1,381,908 | A | * | 6/1921 | Downer | A61G 17/00 27/7 |
| 1,708,443 | A | * | 4/1929 | Fifer | A61G 17/04 27/1 |
| 2,001,360 | A | * | 5/1935 | Heuston | F23G 5/42 110/248 |
| 3,177,827 | A | * | 4/1965 | Melvin | F23G 1/00 110/240 |

(Continued)

FOREIGN PATENT DOCUMENTS

| | | | | | |
|---|---|---|---|---|---|
| GB | 961347 | A | * | 6/1964 | B65D 7/20 |

*Primary Examiner* — William Miller
(74) *Attorney, Agent, or Firm* — Plager Schack LLP

(57) ABSTRACT

A basket apparatus with enhanced strength for use with a water-based pet cremation machine includes a lower basket assembly having an inner compartment formed by a lower frame assembly that constructs a plurality of faces including a front face, a rear face, side faces, and a bottom face, each face having a perforated mesh coupled thereto, at least one divider disposed within the lower basket inner compartment to create a first set of compartments to store pets, an upper basket assembly disposed on the lower basket assembly and having an inner compartment formed by an upper frame assembly that constructs a plurality of faces including a front face, a rear face, side faces and a bottom face, each face having a perforated mesh coupled thereto, and at least one divider disposed within the upper basket inner compartment to create a second set of compartments to store pets.

10 Claims, 5 Drawing Sheets

(56) References Cited

U.S. PATENT DOCUMENTS

| | | | | | |
|---|---|---|---|---|---|
| 3,282,460 | A * | 11/1966 | Boznango | A47J 37/1295 | 206/513 |
| 3,345,960 | A * | 10/1967 | Pierre | F23G 1/00 | 110/246 |
| 4,015,743 | A * | 4/1977 | Beretta | B65D 21/0211 | 206/511 |
| 4,298,127 | A * | 11/1981 | Upshaw | B65D 21/06 | 206/513 |
| 4,456,125 | A * | 6/1984 | Chap | B65D 25/22 | 206/513 |
| 4,508,027 | A * | 4/1985 | McCord | A47J 37/1295 | 220/543 |
| 4,848,620 | A * | 7/1989 | Chap | B65D 21/048 | 206/505 |
| 5,560,286 | A * | 10/1996 | Fabrikant | A47J 37/0694 | 211/181.1 |
| 6,397,764 | B1 * | 6/2002 | Massey | F23G 5/32 | 110/194 |
| 7,481,327 | B2 * | 1/2009 | Cheng | B65D 7/16 | 206/509 |
| 8,235,319 | B2 * | 8/2012 | Sullivan | A61G 17/00 | 241/301 |
| 8,999,254 | B2 * | 4/2015 | Ross | B09B 3/0075 | 422/184.1 |

* cited by examiner

WATER BASED PET CREMATION BASKET APPARATUS WITH ENHANCED STRENGTH

BACKGROUND

The embodiments herein relate generally to baskets used with water-based pet cremation machines.

Water-based pet cremation is a green alternative to traditional cremation procedures, which exposes the corpse of the pet to direct heat and flame. In water-based cremation, the remains of one or more pets are typically disposed within a basket, which is inserted into the cremation machine. The cremation machine heats water and an alkaline solution to a particular temperature, which flows through the basket and contacts the one or more pets. The cremation machine gently agitates the alkaline solution soaking the pet remains. This process accelerates the decomposition of the pet remains.

Current baskets used with water-based pet cremation machines have several limitations. Specifically, the baskets do not have adequate openings to permit water and alkaline solution to flow through and contact the pet remains. This greatly reduces efficiency of the cremation machine. Further, these baskets do not maximize use of available space within the cremation machine and are made of materials that lack strength and durability. As a result, these baskets are not ideal for withstanding the wear and tear associated with the cremation process.

As such, there is a need in the industry for a water based pet cremation basket apparatus with enhanced strength that addresses the limitations of the prior art, which improves water flow through the apparatus and cremation efficiency.

SUMMARY

A basket apparatus with enhanced strength for use with a water-based pet cremation machine is provided. The basket apparatus is configured to store a plurality of pets and enhance water flow therethrough during a cremation procedure. The basket apparatus comprises a lower basket assembly comprising an inner compartment formed by a lower frame assembly that constructs a plurality of faces, the lower frame assembly comprising an upper generally rectangular frame, a lower generally rectangular frame, a first pair of side frame members coupled to the upper and lower rectangular frames of the lower frame assembly, and a second pair of side frame members coupled to the upper and lower rectangular frames of the lower frame assembly, the plurality of faces comprising a front face, a rear face, side faces coupled to the front and rear faces, and a bottom face coupled to the front face, rear face and side faces, each face of the plurality of faces comprising a perforated mesh coupled thereto on a corresponding portion of the lower frame assembly, at least one divider disposed within the inner compartment of the lower basket to create a first set of compartments, each compartment in the first set of compartments configured to store any one of the plurality of pets, an upper basket assembly disposed on the lower basket assembly and comprising an inner compartment formed by an upper frame assembly that constructs a plurality of faces, the upper frame assembly comprising an upper generally rectangular frame, a lower generally rectangular frame, a third pair of side frame members coupled to the upper and lower rectangular frames of the upper frame assembly, and a fourth pair of side frame members coupled to the upper and lower rectangular frames of the upper frame assembly, the plurality of faces comprising a front face, a rear face, side faces coupled to the front and rear faces, and a bottom face coupled to the front face, rear face and side faces, each face of the plurality of faces comprising a perforated mesh coupled thereto on a corresponding portion of the upper frame assembly, and at least one divider disposed within the inner compartment of the upper basket to create a second set of compartments, each compartment in the second set of compartments configured to store any one of the plurality of pets, wherein the upper and lower basket assemblies are disposed within the pet cremation machine to perform the cremation procedure.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
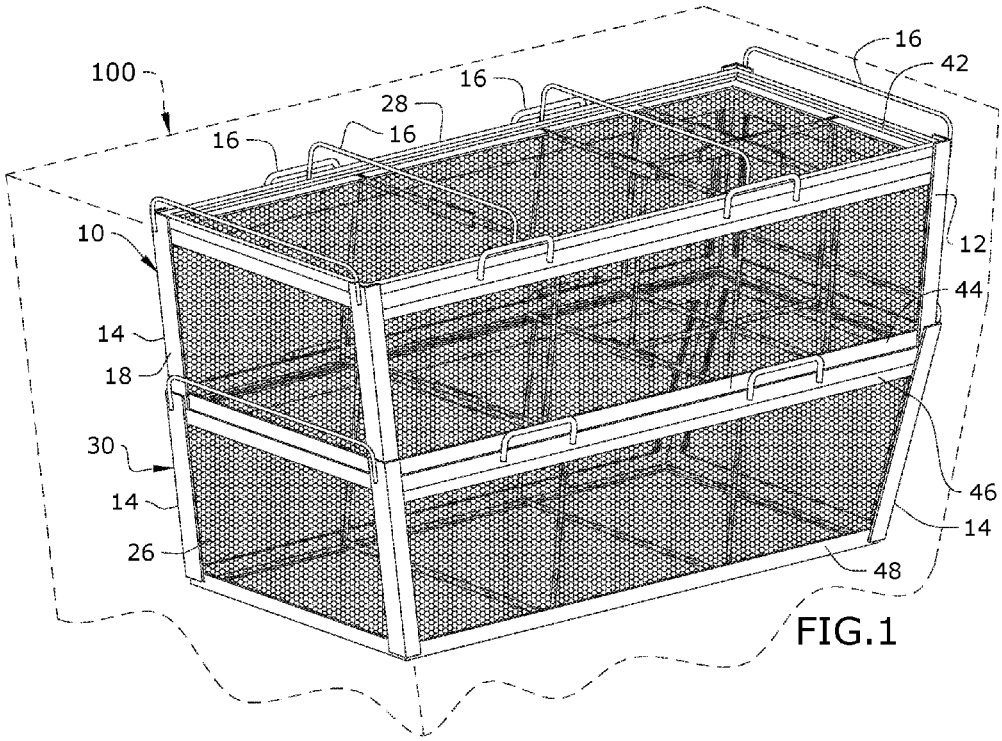
FIG. 1 depicts a perspective view of certain embodiments of the basket apparatus in an assembled configuration.

As depicted in FIGS. 1-6, the basket apparatus is configured to store one or more pet remains (not shown) and be used with water-based cremation machine 100 such as a Bio-Response S2500 machine. The basket apparatus generally comprises upper basket assembly 10, lower basket assembly 30 and top lid 28. Top lid 28, upper basket assembly 10 and lower basket assembly 30 are stacked on top of each other and disposed within water-based cremation machine 100 to perform the cremation procedure. In a preferred embodiment, the basket apparatus is made from stainless steel. However, alternative materials may be used instead.

In certain embodiments, lower basket assembly 30 comprises frame assembly 18, which comprises lower basket upper frame 46, lower basket lower frame 48, and slanted side frame members 14 welded together. Each member of the lower basket upper frame 46 and lower basket lower frame 48 comprises a generally rectangular shape. Perforated mesh members 26 are coupled to the front, rear, side and bottom faces of lower basket assembly 30. In one embodiment, handles 16 are welded to portions of lower basket upper frame 46 and slanted side frame members 14.

Upper basket assembly 10 is configured to be disposed on top of lower basket assembly 30. Upper basket assembly 10 comprises frame assembly 18, which comprises upper basket upper frame 42, upper basket lower frame 44, vertical side frame members 12 and slanted side frame members 14 welded together. In this configuration, each member of upper basket upper frame 42 and upper basket lower frame 44 comprises a generally rectangular shape. A pair of vertical side frame members 12 are coupled on one side of upper basket assembly 10 and oriented generally perpendicular to upper basket upper frame 42 and upper basket lower frame 44. A pair of slanted side frame members 14 are coupled to another side of upper basket assembly 10. Perforated mesh members 26 are coupled to the front, rear, side and bottom faces of upper basket assembly 10. In one embodiment, handles 16 are welded to portions of upper basket upper frame 42, vertical side frame members 12 and slanted side frame members 14.

Figure 3:
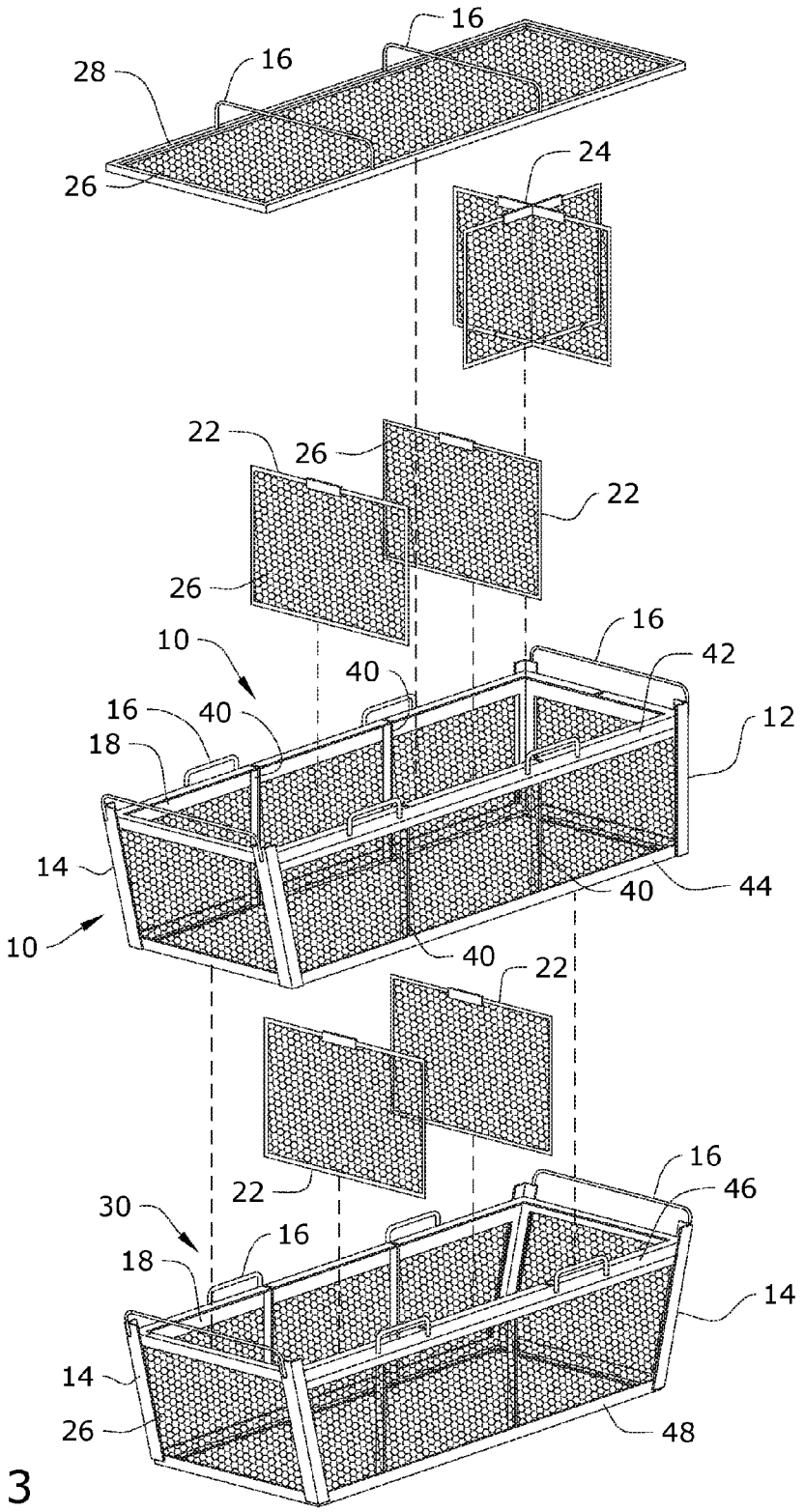
FIG. 3 depicts an exploded view of certain embodiments of the basket apparatus.
Figure 4:
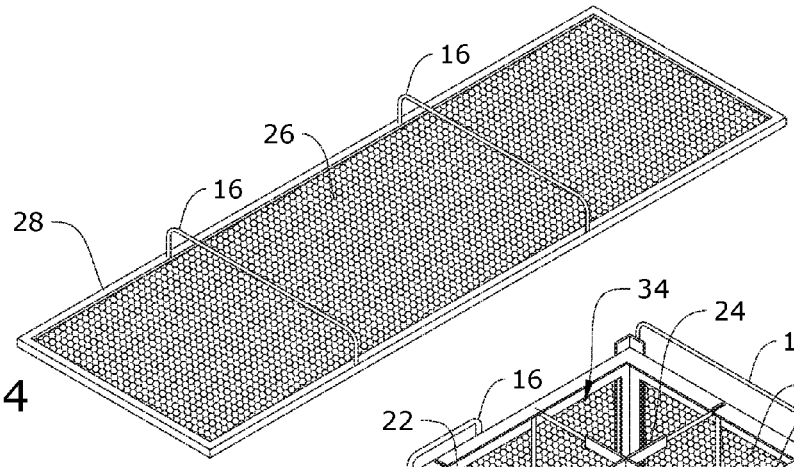
FIG. 4 depicts a perspective view of certain embodiments of the basket apparatus illustrating the lid.
Figure 5:
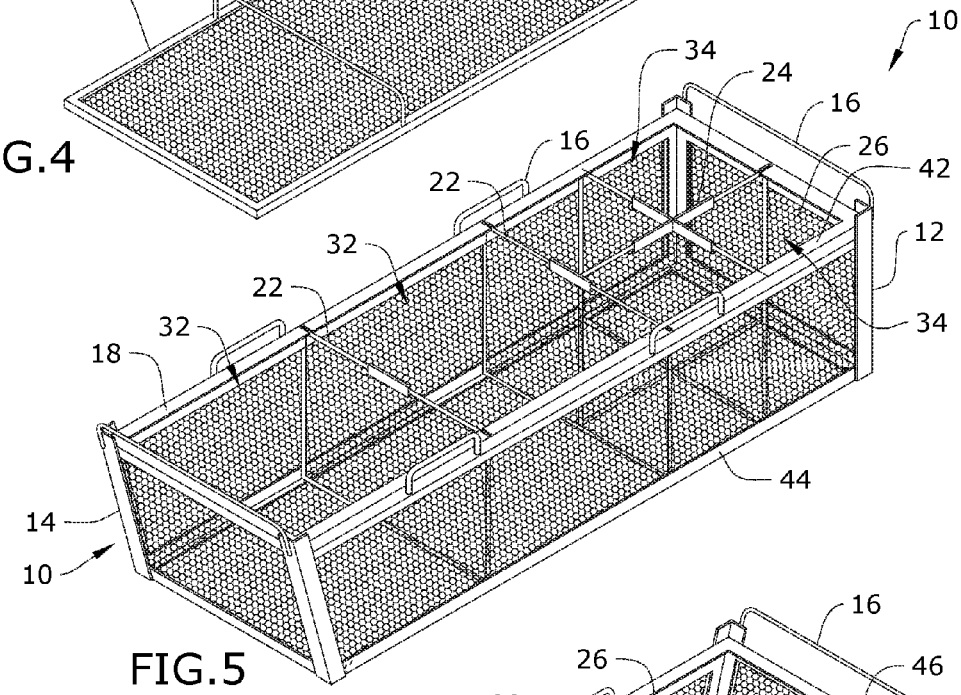
FIG. 5 depicts a perspective view of certain embodiments of the basket apparatus illustrating the upper basket assembly.
Figure 6:
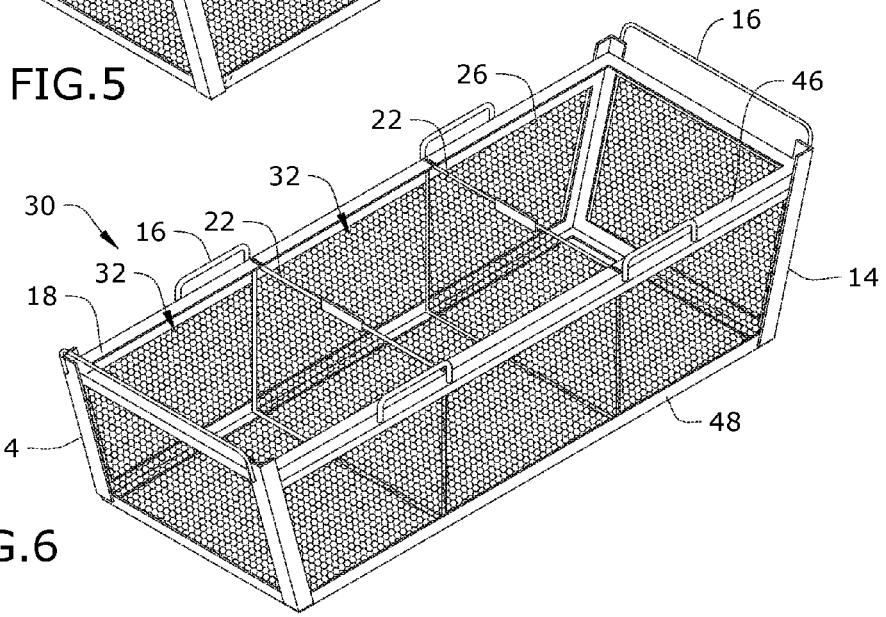
FIG. 6 depicts a perspective view of certain embodiments of the basket apparatus illustrating the lower basket assembly.

Upper basket assembly 10 and lower basket assembly 30 are each configured to receive one or more dividers such as plane dividers 22 and quad divider assembly 24. Plane divider 22 comprises a single planar perforated mesh member. Quad divider assembly 24 comprises a pair of intersecting perforated mesh members coupled together. As depicted in FIGS. 3 and 5, upper basket assembly 10 is configured to receive a pair of plane dividers 22 and quad divider assembly 24 to create large compartments 32 and small compartments 34. As depicted in FIGS. 3 and 6, lower basket assembly 30 is configured to receive a pair of plane dividers 22 to create large compartments 32. In alternative embodiments, it shall be appreciated that different configurations of plane dividers 22 and quad divider assemblies 24 may be used instead in upper basket assembly 10 and/or lower basket assembly 30.

Figure 7:
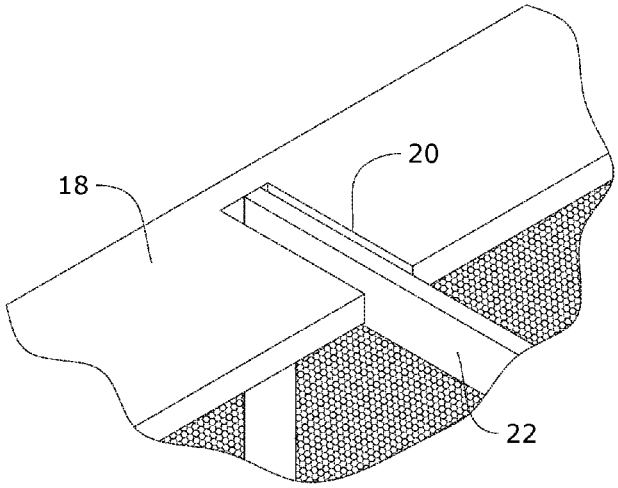
FIG. 7 depicts a perspective view of certain embodiments of the basket apparatus.

As depicted in FIGS. 3 and 7, the edge of each divider 22, 24 is disposed within notch 20 in frame assembly 18 of either upper basket assembly 10 or lower basket assembly 30. A plurality of notches 20 is disposed throughout upper basket upper frame 42 and lower basket upper frame 46 to accommodate dividers 22, 24. Each notch 20 in upper basket assembly 10 and lower basket assembly 30 comprises U-shaped sleeve 40 positioned below and welded to the interior of the corresponding basket assembly. This configuration enhances rigidity and stability of the basket apparatus because each side edge of the divider is disposed within U-shaped sleeve 40 and notch 20 in frame assembly 18. It shall be appreciated that plane dividers 22 and quad divider assembly 24 can easily slide in and out of upper and lower basket assemblies 10, 30 as needed.

As depicted in FIGS. 1-4, top lid 28 is disposed on top of upper basket assembly 10 and comprises a generally rectangular frame, perforated mesh member 26 and handles 16 coupled to the rectangular frame. In a preferred embodiment, perforated mesh members 26 in top lid 28, upper basket assembly 10 and lower basket assembly 30 are made from 14 gauge stainless steel and are ⅛" perforated on a 3/16" stagger. However, perforated mesh members 26 having alternative specifications may be used in other embodiments.

Figure 2:
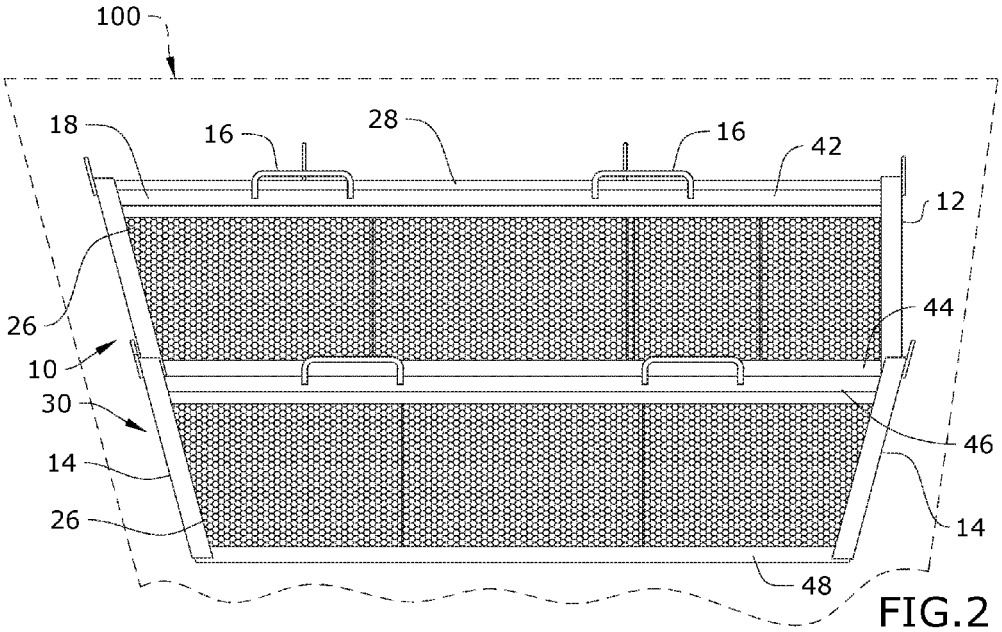
FIG. 2 depicts a side view of certain embodiments of the basket apparatus in an assembled configuration.

In operation, the basket apparatus is assembled as shown in FIG. 3. Pet remains (not shown) are disposed in large compartments 32 and/or small compartments 34 of upper and lower basket assemblies 10, 30. Top lid 28, upper basket assembly 10 and lower basket assembly 30 are stacked together as shown in FIGS. 1-2 and disposed within the basin tub of water-based cremation machine 100. Water-based cremation machine 100 is enabled to permit water and alkaline solution to pass through perforated mesh members 26 of the basket apparatus to contact the pet remains. Water-based cremation machine 100 gently agitates the alkaline solution, which promotes the decomposition process.

Figure 8:
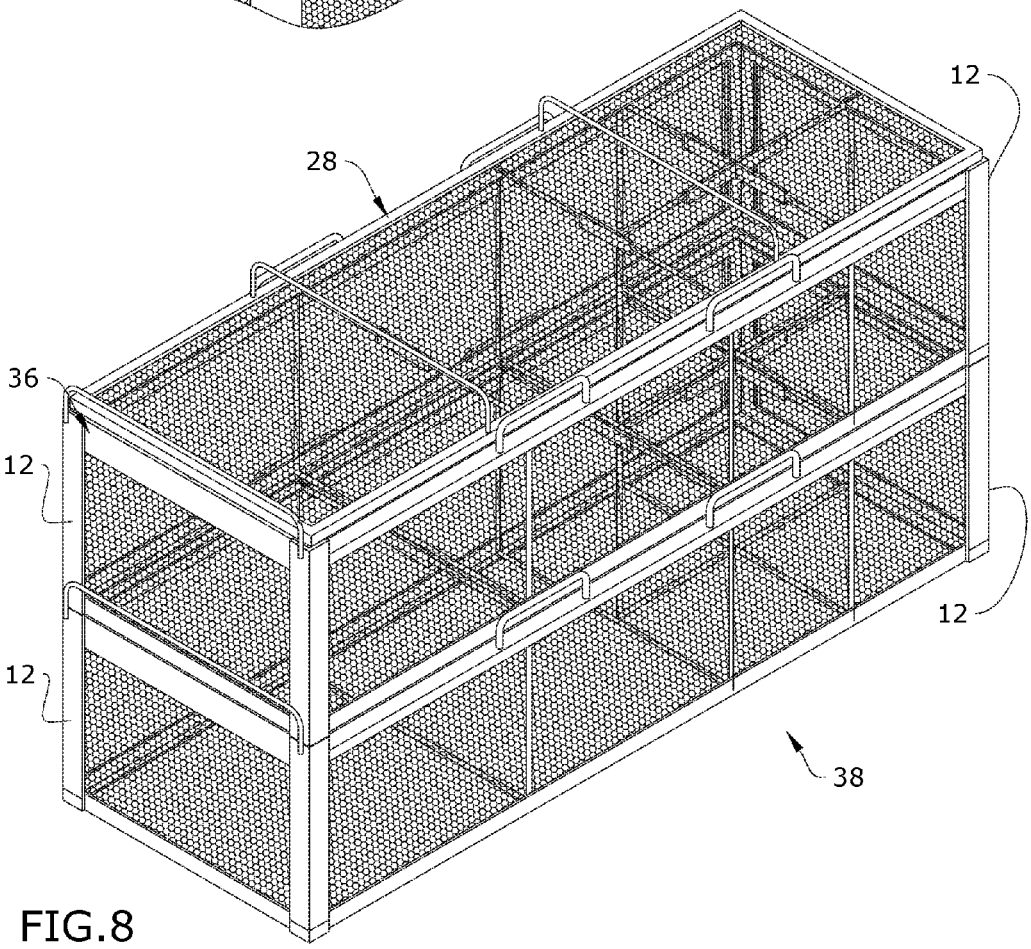
FIG. 8 depicts a perspective view of an alternative embodiment of the basket apparatus.
Figure 9:
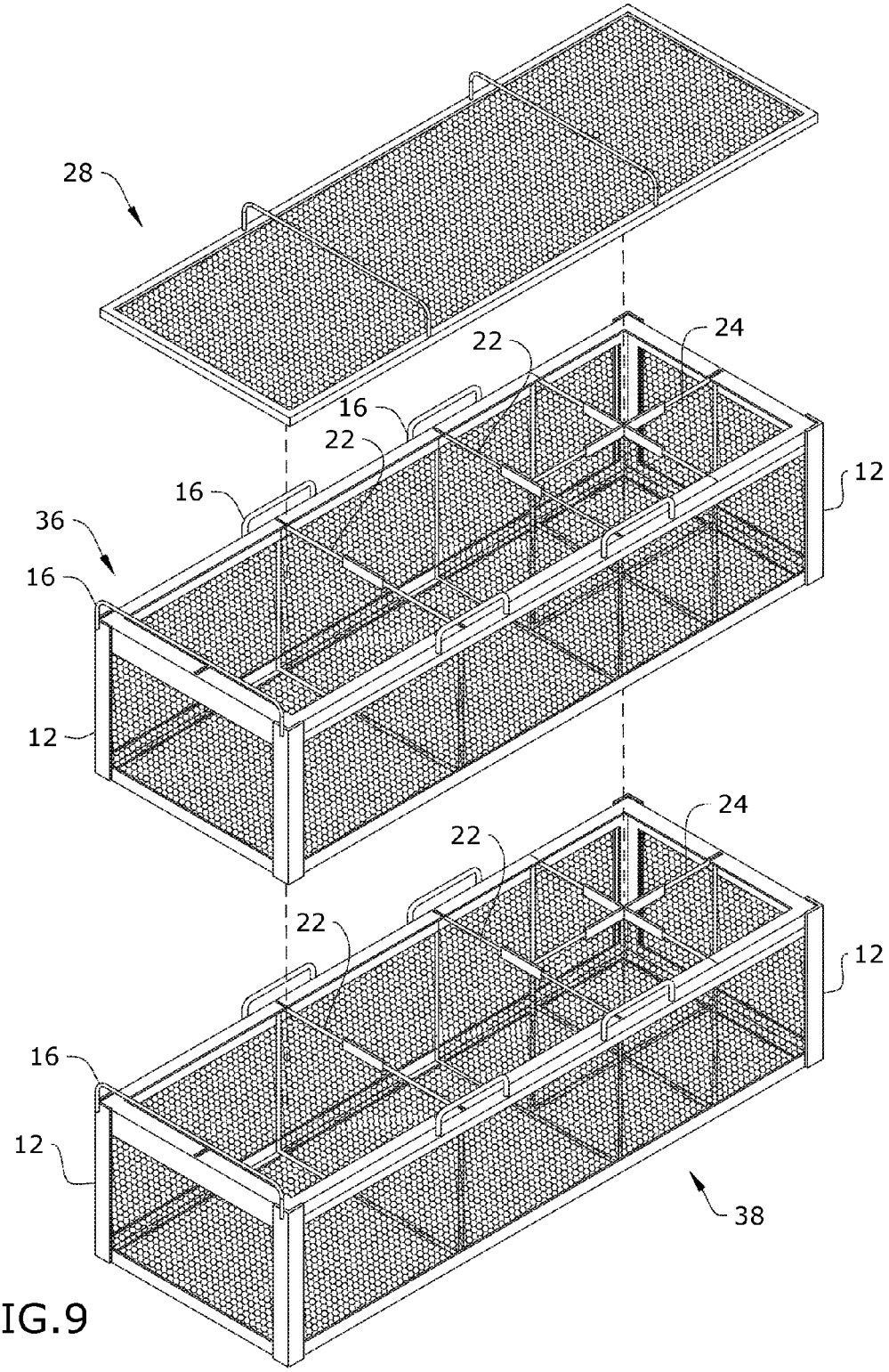
FIG. 9 depicts an exploded view of the alternative embodiment of the basket apparatus.

As depicted in FIGS. 8-9, an alternate basket apparatus is disclosed, which is configured for use with a water-based cremation machine (not shown) such as a Bio-Response S4000 machine. The alternate basket apparatus comprises the same components as the basket apparatus disclosed in FIGS. 1-6, but in a different configuration. More specifically, the alternate basket apparatus comprises top lid 28, alternate upper basket assembly 36 and alternate lower basket assembly 38. Alternate upper basket assembly 36 and alternate lower basket assembly 38 are identical. Each alternate basket assembly 36, 38 comprises vertical side frame members 12 connecting the upper and lower frames together. Each basket assembly of upper and lower basket assemblies 36, 38 are configured to receive a pair of plane dividers 22 and quad divider assembly 24.

The basket apparatus and alternate basket apparatus are advantageous because they maximize the use of space within the water-based cremation machine. Since perforated mesh members 26 are present in top lid 28 and all faces of upper basket assemblies 10, 36 and lower basket assemblies 30, 38, water and alkaline solution flow through the basket apparatus to the pet remains with greater efficiency. This enhances the overall effectiveness of the cremation machine and reduces the time required to complete the cremation process.

It shall be appreciated that the components of the basket apparatus described in several embodiments herein may comprise any alternative known materials in the field and be of any color, size and/or dimensions. It shall be appreciated that the components of the basket apparatus described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A basket apparatus with enhanced strength for use with a water-based pet cremation machine, the basket apparatus configured to store a plurality of pets and enhance water flow therethrough during a cremation procedure, the basket apparatus comprising:

a lower basket assembly comprising an inner compartment formed by a lower frame assembly that constructs a plurality of faces, the lower frame assembly comprising an upper generally rectangular frame, a lower generally rectangular frame, a first pair of side frame members coupled to the upper and lower rectangular frames of the lower frame assembly, and a second pair of side frame members coupled to the upper and lower rectangular frames of the lower frame assembly, the plurality of faces comprising a front face, a rear face, side faces coupled to the front and rear faces, and a bottom face coupled to the front face, rear face and side faces, each face of the plurality of faces comprising a perforated mesh coupled thereto on a corresponding portion of the lower frame assembly;

at least one divider disposed within the inner compartment of the lower basket to create a first set of compartments, each compartment in the first set of compartments configured to store any one of the plurality of pets;

an upper basket assembly disposed on the lower basket assembly and comprising an inner compartment formed by an upper frame assembly that constructs a plurality of faces, the upper frame assembly comprising an upper generally rectangular frame, a lower generally rectangular frame, a third pair of side frame members coupled to the upper and lower rectangular frames of the upper frame assembly, and a fourth pair of side frame members coupled to the upper and lower rectangular frames of the upper frame assembly, the plurality of faces comprising a front face, a rear face, side faces coupled to the front and rear faces, and a bottom face coupled to the front face, rear face and side faces, each face of the plurality of faces comprising a perforated mesh coupled thereto on a corresponding portion of the upper frame assembly; and at least one divider disposed within the inner compartment of the upper basket to create a second set of compartments, each compartment in the second set of compartments configured to store any one of the plurality of pets;

wherein the upper and lower basket assemblies are disposed within the pet cremation machine to perform the cremation procedure.

2. The basket apparatus of claim 1, further comprising a generally rectangular lid detachably coupled to the upper generally rectangular frame of the upper basket assembly and comprising a perforated mesh.

3. The basket apparatus of claim 2, further comprising at least one lid handle.

4. The basket apparatus of claim 3, further comprising a first set of handles coupled to the upper generally rectangular frame of the upper basket assembly and a second set of handles coupled to the upper generally rectangular frame of the lower basket assembly.

5. The basket apparatus of claim 4, wherein each upper generally rectangular frame of the upper and lower basket assemblies comprises a plurality of notches, wherein each notch is configured to receive an edge of the respective at least one divider.

6. The basket apparatus of claim 5, wherein each notch of the plurality of notches in the upper generally rectangular frames of the upper and lower basket assemblies comprises a U-shaped sleeve positioned below and coupled to the upper or lower basket assembly, wherein each U-shaped sleeve is configured to receive an edge of the respective at least one divider.

7. The basket apparatus of claim 6, wherein the at least one divider of the upper basket assembly comprises a first divider perforated mesh and a second divider perforated mesh comprising a pair of intersecting meshes.

8. The basket apparatus of claim 7, wherein the at least one divider of the lower basket assembly comprises a third divider perforated mesh and a fourth divider perforated mesh.

9. The basket apparatus of claim 8, wherein the first and second pairs of side frame members of the lower frame assembly are positioned generally perpendicular to the upper and lower rectangular frames of the lower frame assembly, wherein the third and fourth pairs of side frame members of the upper frame assembly are positioned generally perpendicular to the upper and lower rectangular frames of the upper frame assembly.

10. The basket apparatus of claim 8, wherein the first and second pairs of side frame members of the lower frame assembly are slanted relative to the upper and lower rectangular frames of the lower frame assembly, wherein the third pair of side frame members of the upper frame assembly is slanted relative to the upper and lower rectangular frames of the upper frame assembly, wherein the fourth pair of side frame members of the upper frame assembly is positioned generally perpendicular to the upper and lower rectangular frames of the upper frame assembly.

* * * * *